US009453416B2

(12) United States Patent
Lung et al.

(10) Patent No.: US 9,453,416 B2
(45) Date of Patent: Sep. 27, 2016

(54) AEROFOILS

(71) Applicant: ROLLS-ROYCE PLC, London (GB)

(72) Inventors: Hang Wai Lung, Derby (GB); Martin Neil Goodhand, Wiltshire (GB); Robert John Miller, Cambridge (GB)

(73) Assignee: ROLLS-ROYCE plc, London (GB)

( * ) Notice: Subject to any disclaimer, the term of this patent is extended or adjusted under 35 U.S.C. 154(b) by 960 days.

(21) Appl. No.: 13/673,334

(22) Filed: Nov. 9, 2012

(65) Prior Publication Data

US 2013/0129516 A1 May 23, 2013

(30) Foreign Application Priority Data

Nov. 14, 2011 (GB) ..... 1119531.0

(51) Int. Cl.
*F01D 5/14* (2006.01)

(52) U.S. Cl.
CPC ..... *F01D 5/141* (2013.01)

(58) Field of Classification Search
CPC ..... F01D 5/141
USPC ..... 415/181
See application file for complete search history.

(56) References Cited

U.S. PATENT DOCUMENTS

| | | | | |
|---|---|---|---|---|
| 4,655,412 | A * | 4/1987 | Hinkleman | B64C 3/14 244/35 R |
| 5,352,092 | A | 10/1994 | Ferleger et al. | |
| 6,017,186 | A * | 1/2000 | Hoeger | F01D 5/143 415/181 |
| 2008/0118362 | A1 | 5/2008 | Hu et al. | |

FOREIGN PATENT DOCUMENTS

| | | |
|---|---|---|
| JP | A-2003-254074 | 9/2003 |
| WO | WO 2005/064121 A1 | 7/2005 |
| WO | WO 2006/053579 A1 | 5/2006 |
| WO | WO 2010/057627 A1 | 5/2010 |
| WO | WO 2011/026714 A1 | 3/2011 |

OTHER PUBLICATIONS

Garzon et al., "Impact of Geometric Variability on Axial Compressor Performance," *Journal of Turbomachinery*, Oct. 2003, pp. 692-703, vol. 125.

Goodhand et al., "Compressor Leading Edge Spikes: A New Performance Criterion," *Journal of Turbomachinery*, Apr. 2011, pp. 021006-1-021006-8, vol. 133.

British Search Report issued in British Application No. 1119531.0 dated Feb. 16, 2012.

* cited by examiner

*Primary Examiner* — Richard Edgar
(74) *Attorney, Agent, or Firm* — Oliff PLC

(57) ABSTRACT

An aerofoil having a leading edge point within a leading edge region and a pressure surface with a profile wherein within the leading edge region the pressure surface profile has a local minimum. The local minimum reduces the loss which may be caused by high negative incidence on to the blade.

16 Claims, 6 Drawing Sheets

AEROFOILS

The present invention relates to aerofoils and in particular aerofoils which can experience transonic flow at the leading edge under certain operating conditions. The invention finds particular application in aerofoils of compressors such as those within gas turbine engines.

Modern compressor blades are carefully designed to ensure efficient compression over a wide range of operating conditions. Deterioration from this design intent whether due to variability in the manufacture process or particle impact during operation, will reduce both the mean efficiency and operating range whilst increasing the variability in performance between blades.

The leading edge is the region of the blade that is most prominent to the flow and thus the most susceptible to particle collision. It is also the region most affected by manufacture deviations: by performing two-dimensional computations on a transonic rotor at design incidence, Garzon and Darmofal, 2003, "Impact of geometric variability on axial compressor performance" ASME Journal of Turbomachinery, 125, pp. 692-703, demonstrated that this small region, over the first few percent of the chord, produced nearly all the increase in mean loss as well as nearly all the variability between blades when measured manufacture deviations were imposed.

Some modern design methods, such as the method of Goodhand and Miller, 2011, "Compressor leading edge spikes: a new performance criterion". ASME Journal of Turbomachinery, 133(2) pp. 021006, can produce leading edges which allow smooth acceleration of flow over them. Prior to this ellipses or circles were used which caused the flow to overspeed around the leading edge, resulting in a spike in the surface pressure distribution.

It is an object of the present invention to seek to provide an improved aerofoil which is more robust to a flow incidence that deviates from the design incidence and which is less susceptible to manufacturing defects.

According to a first aspect of the invention there is provided an aerofoil having a leading edge point within a leading edge region and a pressure surface with a profile wherein within the leading edge region the pressure surface profile has a local minimum.

Preferably the leading region extends along a fraction of the pressure surface length from the leading edge point also has a local maximum located further along the pressure surface length than the local minimum.

The leading edge region preferably extends along a fraction of the pressure surface length from the leading edge point, the fraction is less than 0.05 of the pressure surface length $S_p$. Preferably the fraction is less than 0.02 of the pressure surface length $S_p$.

The local minimum may be located at a pressure surface fraction of 0.01 of the pressure surface length from the leading edge point.

Preferably the peak displacement $\delta p$ of the local minimum is between 10 and 40% of $r_{LE}$, where $r_{LE}$ is the radius of a circular leading edge.

The aerofoil may further comprising a suction surface and a trailing edge, the suction surface and the pressure surface being joined at the leading edge point and the trailing edge.

The aerofoil may have a flow over the leading edge region with an inviscid surface Mach number greater than 1.

Preferably the aerofoil is a compressor aerofoil. The aerofoil may be within a turbine engine.

According to a second aspect of the invention there is provided a method for defining part of the shape of an aerofoil, the aerofoil having a leading edge point within a leading edge region having a pressure surface profile, the method comprising the following steps: defining a starting profile for a curvature of the pressure surface profile; defining a nominal point within the leading edge region at which supersonic flow is expected; defining a new profile of curvature of the pressure surface between the leading edge and the nominal point, wherein the new profile has a local minimum of curvature.

Preferably the pressure surface profile of the leading edge region is less than 0.05 of the total length of the aerofoil pressure surface Sp.

The invention will now be described, by way of example only, with reference to the accompanying drawings in which.

Figure 6A:
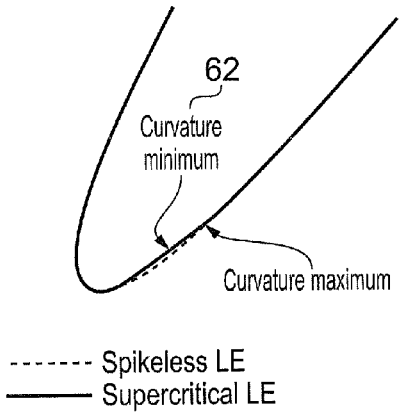
Figure 6B:
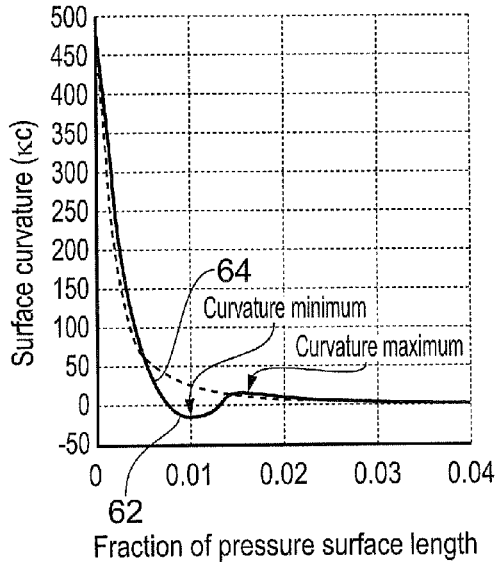
Figure 7:
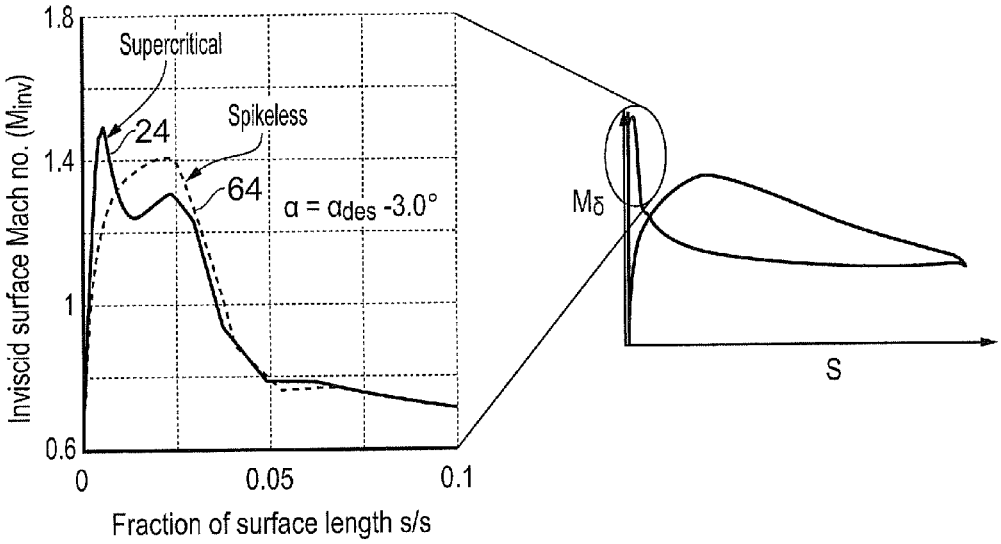

FIGS. 6(A) and 6(B) depict a leading edge profile of a compressor blade according to the present invention;

FIG. 7 shows the inviscid surface Mach number distribution at flow inlet angle 3 degrees below design incidence as a comparison of the compressor blade with a spikeless leading edge 24 of FIG. 2 and the compressor blade of the invention 64 of FIG. 6.

Figure 2:
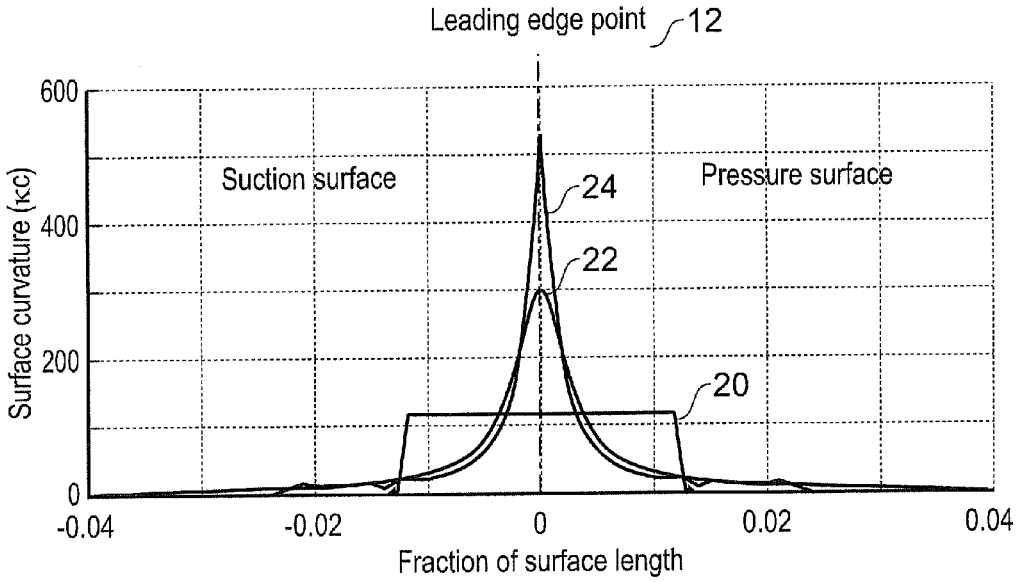
FIG. 2 shows leading edge curvature distributions for three forms of leading edge.
Figure 8:
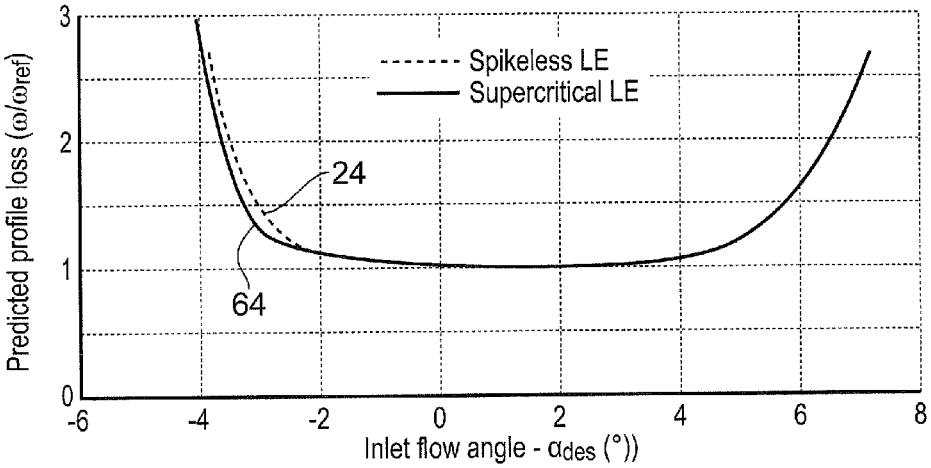

FIG. 8 shows the improvement in negative incidence range as a comparison of the spikeless compressor blade 24 of FIG. 2 and the compressor blade of the invention 64 of FIG. 6.

Figure 9A:
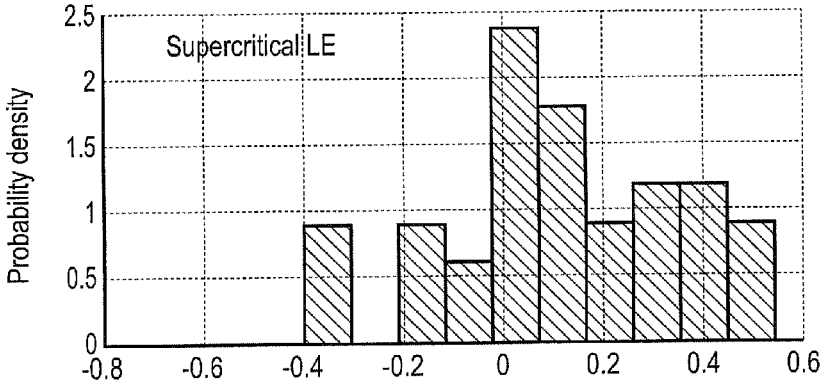
Figure 9B:
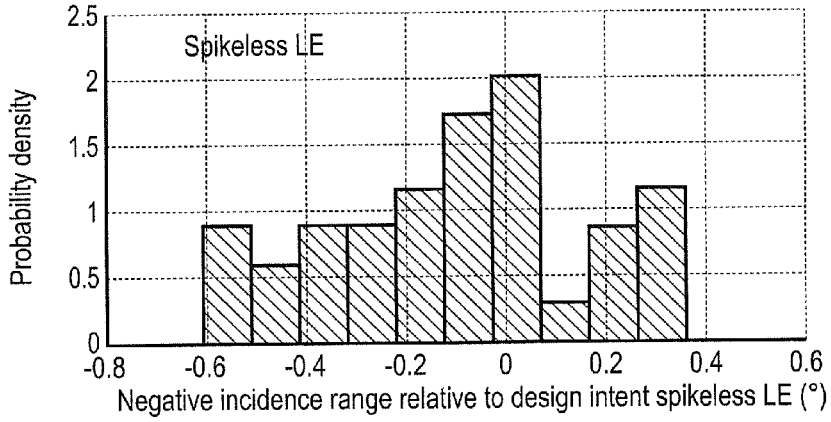

FIGS. 9(A) and 9(B) are a comparison of the probability of negative incidence range for leading edges with manufacture deviations.

Figure 10:
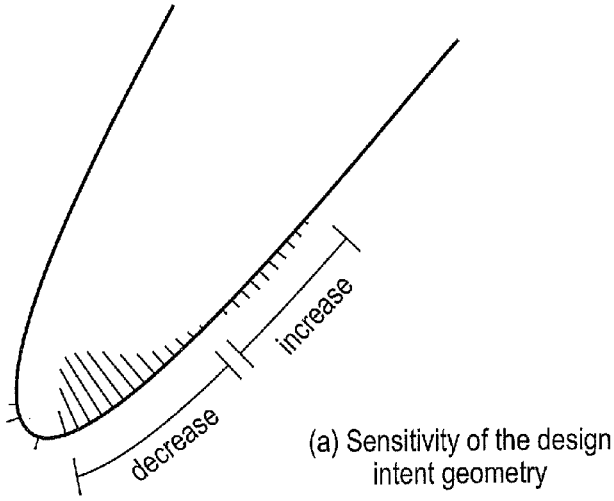

FIG. 10 depicts the impact on negative incidence of a bump located on the pressure surface profile.

Figure 11:
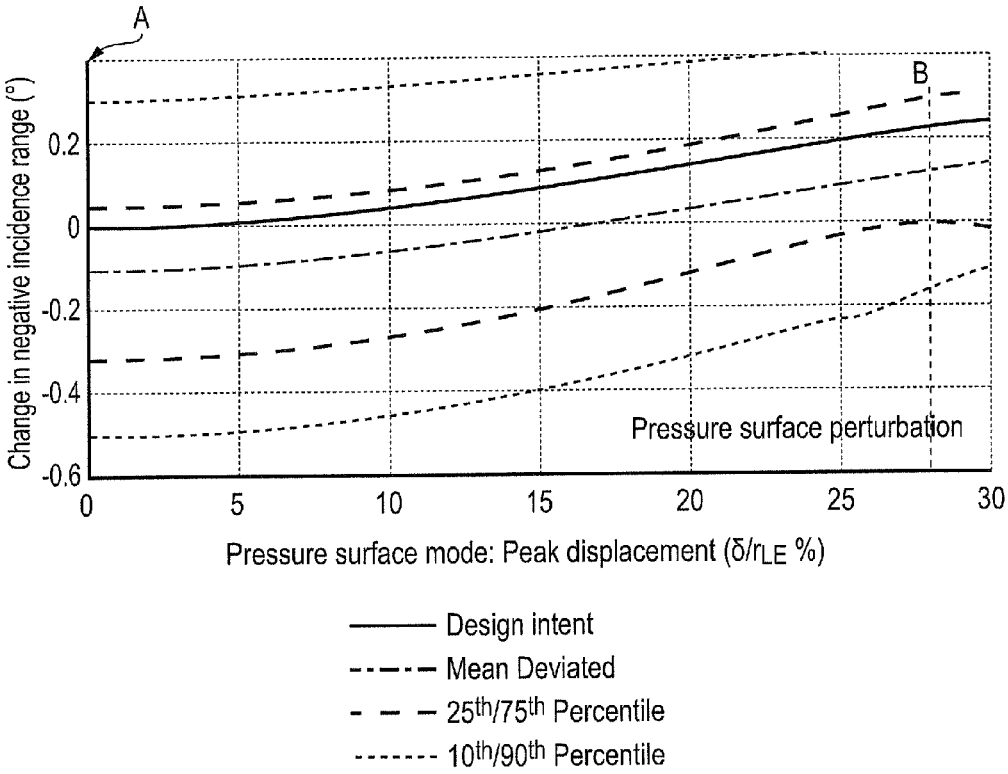

FIG. 11 depicts the effects of perturbation magnitude on negative incidence range relative to the design intent with no perturbations.

Figure 1:
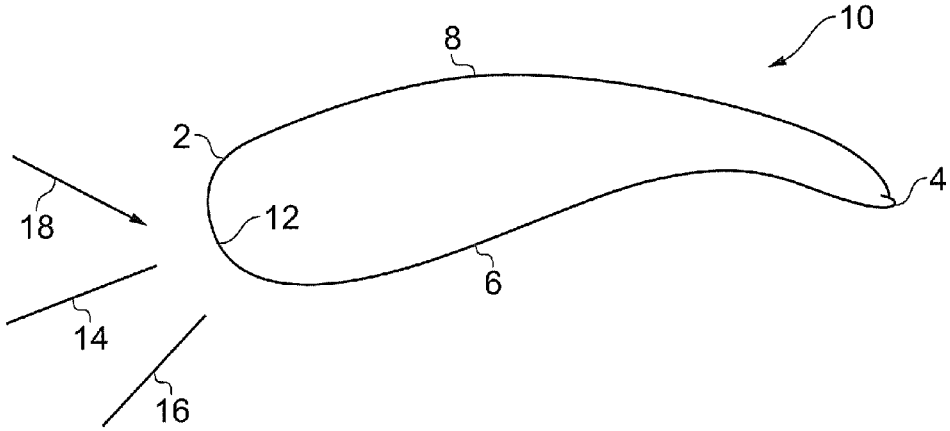
FIG. 1 depicts a compressor blade.

FIG. 1 depicts a mid-height cross-section through a compressor blade aerofoil 10 which has a leading edge 2 and a trailing edge 4 and a pressure flank or surface 6 and a suction flank or surface 8 which connect the leading edge and the trailing edges on opposing sides of the aerofoil. The aerofoil is one of an array of aerofoils, the array extending circumferentially around an axis of the engine (not shown). Where the aerofoil is an aerofoil on a rotor blade the aerofoil is mounted to a rotatable hub which rotates around the axis in the direction of the arrow. Where the aerofoil is a stator the aerofoil is fixed such that it does not rotate about the engine axis. The leading edge has a leading edge point 12 which is the point of transition between the pressure flank and suction flank at the leading edge region where the derivative of the curvature of the aerofoil around the leading edge is zero which is the point of maximum curvature.

FIG. 2 shows the leading edge curvature distributions for 3 reported leading edge types. The first type 20 is an aerofoil with a circular profile. Such blades have a constant surface curvature kC over a relatively long fraction of the surface length of the leading edge region. Such leading edges are robust, but inflexible, and cause losses due to the high curvature changes as the circle merges with the suction or pressure surfaces. The second type of leading edge shown is of an elliptical profile 22 which has a higher surface curvature near to the leading edge point but a lower curvature and smoother transition to the pressure or suction flanks of the aerofoil. Elliptical leading edges cause less loss than the circular leading edges and are therefore more efficient but have been found to be more difficult to implement. The third type of leading edge shown 24 is that of a "spikeless" aerofoil of the type designed in accordance with the teaching in WO2010/057627. The aerofoil has a very high surface curvature at the leading edge point when compared with both the elliptical leading edge and the circular leading edge with a sharp drop in the curvature leading to a smooth transition into the pressure and suction flanks. This form of leading edge offers the least loss and the widest acceptable incidence range when compared with the other two types of leading edge described in this paragraph.

The leading edge region extends along a fraction of both the suction flank 8 and the pressure flank 6 from the leading edge point 12. For elliptical or circular leading edge regions the region extends from the leading edge point to the end of their respective curvature discontinuities i.e. for the aerofoils plotted in FIGS. 2, 0.022 and 0.014 of the total respective surface length of the respective pressure or suction flank. For the compressor with the spikeless leading edge the leading edge region terminates at a fraction length of 0.04.

Compressor aerofoils are arranged within an aerofoil such that the leading edge point is presented to the oncoming flow of the working fluid, typically air, but may be water or another liquid or gas, at a design incidence 14, FIG. 1. At design incidence the boundary layer flow over the leading edge surface is typically entirely subsonic. However, in usual operation the incidence on the aerofoil can vary from that of the design incidence to either a positive incidence 16, FIG. 1 or a negative incidence 18, FIG. 1.

Figure 3:
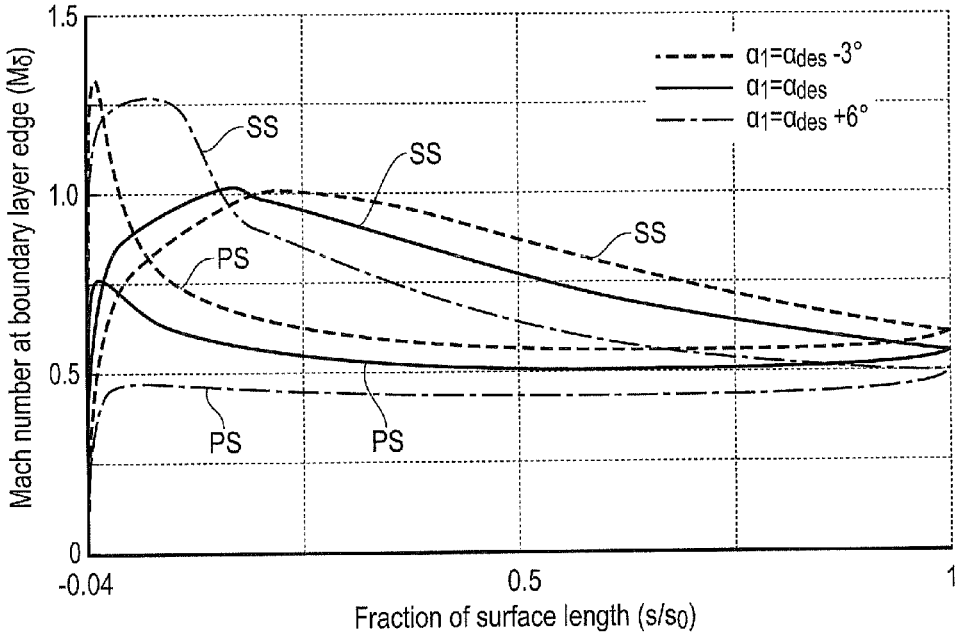
FIG. 3 depicts the boundary layer edge Mach number distributions along the length of the aerofoil at three flow incidences onto the leading edge

Calculations on a rotor midheight section of an aerofoil with a spikeless leading edge were performed under varying flow incidence and the results of Mach number at the boundary layer edge ($M_\delta$) plotted in FIG. 3 over the whole length ($s_0$) of the aerofoil from the leading edge point to the trailing edge. The values for both the suction surface and pressure surface are plotted and are denoted ss and ps respectively. The negative incidence and the positive incidence at −3 degrees and +6 degrees from design incidence respectively represent the incidences at which the loss exceeds 150% of the loss at the design incidence. The graph shows that as the incidence is increased the flow becomes locally supersonic on the suction surface and as the incidence is decreased the flow becomes locally supersonic on the pressure surface. The onset of negative incidence failure, which is the point at which the limit of operation is reached and for these examples it is determined as the point at which the loss has risen to 150% of the design values, occurs close to the leading edge point whereas the positive incidence failure occurs over a larger region.

Figure 4A:
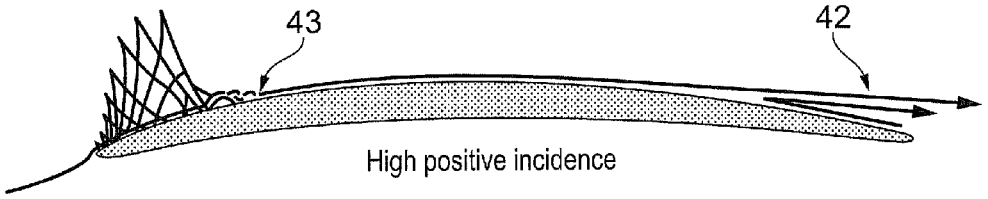
FIGS. 4(A) and 4(B) are schematics showing flow characteristics as well as a cartoon of the boundary layers at the onset of failure.
Figure 4B:
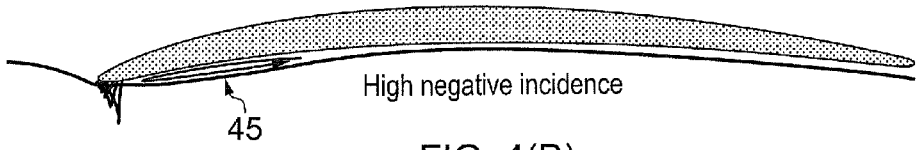

FIG. 4 depicts a schematic showing the flow characteristics as well as a cartoon showing the boundary layer development at the onset of failure for a compressor aerofoil with a spikeless leading edge for high positive incidence FIG. 4(*a*) and high negative incidence FIG. 4(*b*). The reference numerals, 42, 43, 45 are as used in FIG. 5

Figure 5:
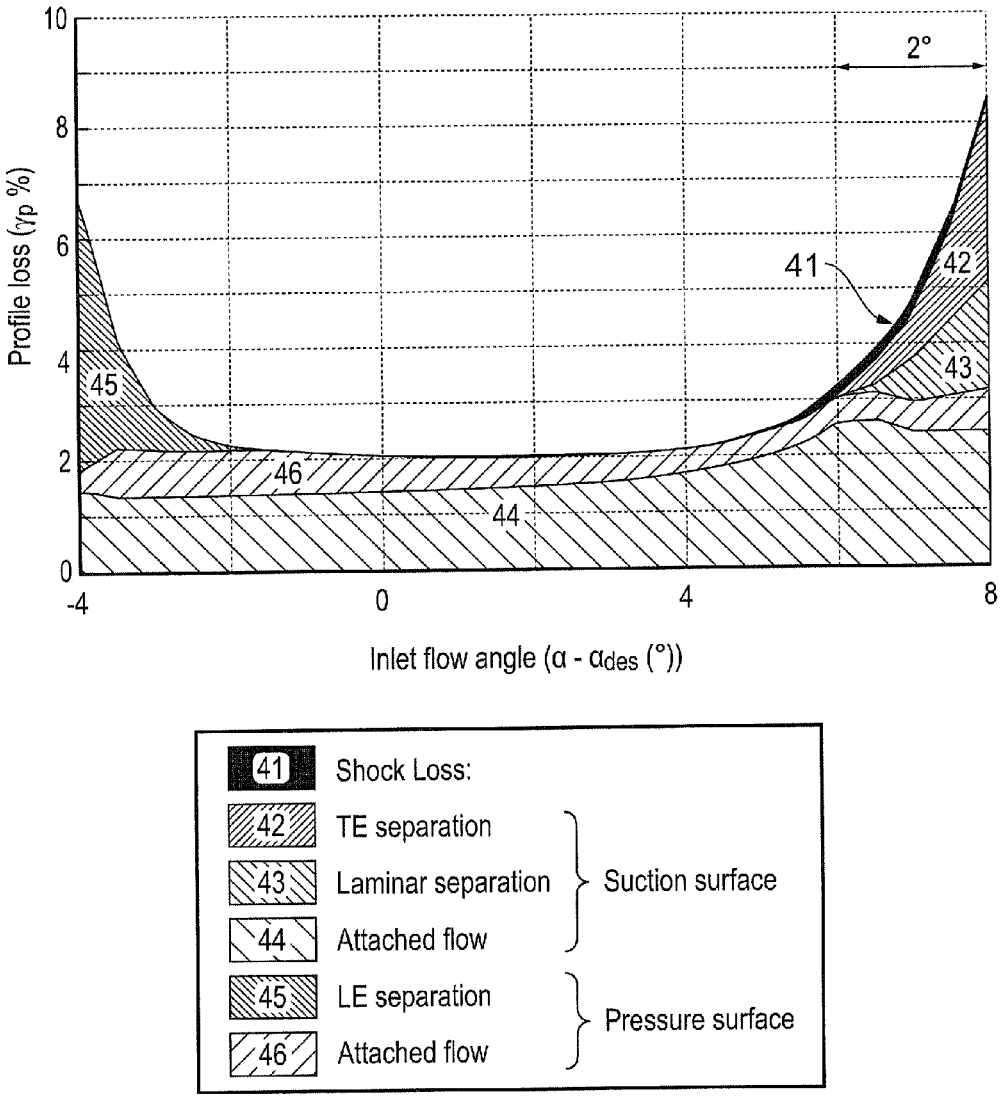
FIG. 5 depicts the breakdown of profile loss on a compressor blade with a spikeless leading edge 24 of FIG. 2

At design incidence, and over the majority of the incidence range, the flow is fully attached resulting in a fairly constant, low level of loss and is the summation of 44 and 46 of FIG. 5. If a spike exists that is large enough to cause flow separation the flow reattaches turbulent which increases the loss by around 30%. More loss is generated on the suction surface due to the higher boundary layer edge velocities compared with the pressure surface.

At high positive incidences the loss increases due to the mid-chord shock separating the laminar boundary layer. Approximately 50% of the increased loss is generated in this laminar separation 43 with the remaining 50% generated in a trailing edge separation 42 caused by a tired thickened turbulent boundary layer which has been generated by a combination of the total surface suction diffusion and the extra losses associated with the upstream shock induced separation.

At high negative incidences the loss increases due to a leading edge separation 45 on the pressure surface region. The shock induced separation as the flow becomes supersonic occurs as the blade approaches choke and is very local to the leading edge.

It has been determined, therefore, that whilst positive incidence failure may be influenced by the leading edge it is unlikely to be dominated by it. However, negative incidence failure is likely to be dominated by the leading edge profile.

To mitigate these effects the pressure surface at the leading edge is modified such that it has a local minimum 62 in its curvature in its curvature distribution as shown in FIG. 6. In this exemplary distribution of surface curvature there is a change in the sign of curvature i.e. the surface is inflectional. However, it should be appreciated that an inflectional surface is not an essential element of the invention and the invention would provide an improved benefit with the local minimum alone. The local minimum should be located within the leading edge region which may be determined as either the first 0.05 fraction of pressure surface length from the leading edge point or four times the radius of an equivalent circular leading edge $r_{LE}$. Preferably the local minimum lies within the first 0.02 fraction of the pressure surface length.

The local minimum should be located within the region where the flow on the pressure surface may be supersonic at non-design incidence as the reduction in curvature associated with the local minimum allows isentropic recompression at high negative incidences on the pressure surface which will reduce the shock strength. FIG. 7 depicts the performance of an aerofoil with a local minimum at the leading edge compared with the performance of an unmodified aerofoil at a negative incidence of design minus 3°. It can be noted that the maximum inviscid surface Mach number ($M_{inv}$) is reduced. Beneficially, the improved leading edge has an increased negative incidence range but has no impact at the design or positive incidence range. This is shown in FIG. 8 which plots the inlet flow angle against the profile loss (omega/omega$_{ref}$). As may be seen the point at which the profile losses begin to rise significantly is at a more negative inlet flow angle for the aerofoil with the local minimum at the leading edge; the effective operating window is enlarged.

The invention offers a further advantage in that tolerances in manufacture may be increased whilst maintaining an acceptable operating incidence range and/or reducing variability between blades. FIG. 9 depicts, in the form of a histogram of negative incidence range for two leading edge types: the baseline spikeless leading edge, and a leading edge having a local minimum at the pressure surface. The figure shows that with the supercritical leading edge the mean negative incidence range is around 0.2 degrees higher and that the variability in negative incidence range between blades is slightly lower.

To determine the geometry of the pressure surface the sensitivity of the surface to small perturbations at the leading edge for extreme negative incidence was measured for a range of perturbations. By combining the effect of all the perturbations, a mode was found that could be used to improve the negative incidence range.

The small perturbations initially added were symmetrical fifth order Hicks-Henne bump functions, using the same method as Duffner (2006). A single bump was applied at a specified surface location; the height of the perturbation, δp, was 0.5% of rLE, (rLE is the radius of an equivalent circular leading edge) the length of the perturbation, Lp, was 4rLE. The impact of the perturbation on positive and negative incidence range was calculated. This method was then repeated with the bump in many locations around the leading edge. It was observed that the results were independent of bump length and linear with bump height over the displacements tested ($-4\% < \delta p/rLE < 4\%$).

The effects of the individual bumps are shown in FIG. 10. The figure shows the regions of sensitivity to negative incidence range. The lines perpendicular to the surface represent the impact on the negative incidence range for a bump at that location; an adverse impact is represented by an inward line. The negative incidence range is only affected by bumps on the pressure surface; away from the leading edge the bumps had little effect on performance. The second observation is that a sensitivity mode emerges and it is by applying a local minimum on the pressure surface around the leading edge where the supersonic region exists that sensitivity to negative incidence is reduced.

The negative incidence range improving mode was added to the leading edge with varying amplitude, and the consequences on negative incidence range improvement are shown in FIG. 11. For a given blade it shows that as the magnitude of the mode added is increased the negative incidence range also increases. Lines showing the $10^{th}/90^{th}$ and $25^{th}$ and $75^{th}$ percentiles are plotted to show where the majority of the blades operate ($10^{th}/90^{th}$) and where the middle 50% of the blades operate ($25^{th}/75^{th}$). Both these ranges narrow as the mode is added.

The histogram of FIG. 9 was determined using values of δp/rLE of 0 for the spikeless LE and 28 for the leading edge of FIG. 6.

The invention described above allows compressor blades to operate over wider operating ranges by increasing the negative incidence range without compromising the positive incidence range. It also allows compressor blades to have the same negative incidence range, but increase the positive incidence range by increasing the inlet metal angle. Such a change can increase the stall margin and may beneficially affect the surge margin.

Beneficially this design of leading edge is robust to manufacture deviations.

The local minimum may be applied to any aerofoil shape which experiences transonic flow or supersonic flow at negative incidence, but which has subsonic flow at design incidence. Such aerofoils may find use, for example, as splitters, struts, fairings, pylons, centrifugal or axial compressors, windmills, wind turbines, lift generating aerofoils.

The design is also applicable to aerofoils operating in liquids or gasses which allow transonic behaviour and where incidence range is important.

The invention claimed is:

1. An aerofoil having a leading edge point within a leading edge region and a pressure surface with a profile, wherein within the leading edge region, the pressure surface profile has a local minimum of curvature, and the leading edge region extends along a fraction of a length of the pressure surface from the leading edge point, the fraction being less than 0.05 of the length of the pressure surface $S_p$.

2. The aerofoil according to claim 1, wherein the leading edge region has a local maximum of curvature located further along the length of the pressure surface from the leading edge point than the local minimum of curvature.

3. The aerofoil according to claim 1, wherein the fraction is less than 0.02 of the length of the pressure surface $S_p$.

4. The aerofoil according to claim 1, wherein the local minimum of curvature is located at a pressure surface fraction of 0.01 of the length of the pressure surface from the leading edge point.

5. The aerofoil according to claim 1, wherein a peak displacement δp of the local minimum of curvature is between 10 and 40% of $r_{LE}$, where $r_{LE}$ is a radius of a circular leading edge.

6. The aerofoil according to claim 1, further comprising a suction surface and a trailing edge, the suction surface and the pressure surface being joined at the leading edge point and the trailing edge.

7. An aerofoil having a leading edge point within a leading edge region and a pressure surface with a profile, wherein within the leading edge region, the pressure surface profile has a local minimum of curvature, and a peak displacement δp of the local minimum of curvature is between 10 and 40% of $r_{LE}$, where $r_{LE}$ is a radius of a circular leading edge.

8. The aerofoil according to claim 7, wherein the leading edge region extends along a fraction of a length of the pressure surface from the leading edge point, the fraction being less than 0.05 of the length of the pressure surface $S_p$, and the leading edge region has a local maximum of curvature located further along the length of the pressure surface from the leading edge point than the local minimum of curvature.

9. A compressor, comprising:

a rotor; and a stator, wherein the rotor is configured to rotate relative to the stator, the rotor or the stator includes a blade having an aerofoil, the aerofoil having a leading edge point within a leading edge region and a pressure surface with a profile, within the leading edge region, the pressure surface profile has a local minimum of curvature, and a peak displacement δp of the local minimum of curvature is between 10 and 40% of $r_{LE}$, where $r_{LE}$ is a radius of a circular leading edge.

10. The compressor according to claim 9, wherein the leading edge region of the aerofoil extends along a fraction of a length of the pressure surface from the leading edge point, and the leading edge region of the aerofoil has a local maximum of curvature located further along the length of the pressure surface from the leading edge point than the local minimum of curvature.

11. The compressor according to claim 10, wherein the fraction is less than 0.05 of the length of the pressure surface $S_p$.

12. The compressor according to claim 11, wherein the fraction is less than 0.02 of the length of the pressure surface $S_p$.

13. The compressor according to claim 12, wherein the local minimum of curvature is located at a pressure surface fraction of 0.01 of the length of the pressure surface from the leading edge point.

14. The compressor according to claim 9, wherein the rotor or the stator includes a plurality of blades, each of the plurality of blades having an aerofoil, the aerofoil having a leading edge point within a leading edge region and a pressure surface with a profile, and within the leading edge region, the pressure surface profile has a local minimum of curvature.

15. The compressor according to claim 14, wherein the plurality of blades are mounted in an array to a hub of the rotor, the hub being rotatable about an axis, the array extending circumferentially about the axis.

16. The compressor according to claim 14, wherein the plurality of blades are mounted in an array to a casing of the stator, the casing extending about an axis, each aerofoil extending radially inward from the casing towards the axis.

* * * * *